United States Patent [19]

Dunn et al.

[11] Patent Number: 4,852,325

[45] Date of Patent: Aug. 1, 1989

[54] REINFORCED BEAD

[75] Inventors: James J. Dunn, St. Charles; Martin D. Jahn, Chicago; Ronald W. Vukmanic, Naperville, all of Ill.

[73] Assignee: Chicago Metallic Corporation, Chicago, Ill.

[21] Appl. No.: 296,853

[22] Filed: Jan. 13, 1989

Related U.S. Application Data

[63] Continuation of Ser. No. 112,549, Oct. 26, 1987, abandoned.

[51] Int. Cl.[4] ..... E04B 5/52

[52] U.S. Cl. ..... 52/729; 52/484; 52/720; 52/730

[58] Field of Search ..... 52/729, 730, 731, 664–667, 52/484, 488, 720, 732

[56] References Cited

U.S. PATENT DOCUMENTS

| | | | |
|---|---|---|---|
| Re. 31,528 | 3/1984 | Mieyal | 52/484 |
| 991,603 | 5/1911 | Brooks . | |
| 2,448,362 | 8/1948 | Earhart | 52/729 |
| 4,409,771 | 10/1983 | Lowe | 52/729 |
| 4,455,806 | 6/1984 | Rice | 52/729 X |
| 4,520,609 | 6/1985 | Worley et al. | 52/484 |

FOREIGN PATENT DOCUMENTS

| | | | |
|---|---|---|---|
| 2634576 | 2/1978 | Fed. Rep. of Germany . | |
| 1068482 | 6/1954 | France . | |
| 827723 | 5/1981 | U.S.S.R. . | |
| 545200 | 6/1940 | United Kingdom | 52/729 |

OTHER PUBLICATIONS

"Heavy Duty Main Tee", 3-6-64, Donn Products, Inc, Westlake, Ohio.

*Primary Examiner*—David A. Scherbel
*Assistant Examiner*—Richard E. Chilcot, Jr.
*Attorney, Agent, or Firm*—Hill, Van Santen, Steadman & Simpson

[57] ABSTRACT

A grid tee or member for suspended ceilings has a reinforced bead, a central web and a pair of flangs formed from a single sheet of metal. The reinforced bead has a continuous outer upper surface and can either be a hollow reinforced bead with a rectangular or triangular configuration or a solid bead having a thickness of at least four layers. The hollow bead structure can have a single layer for the top continuous surface with at least two side portions having at least three layer thicknesses, or can be a single top layer, which has more than three layers.

27 Claims, 1 Drawing Sheet

FIG. 1
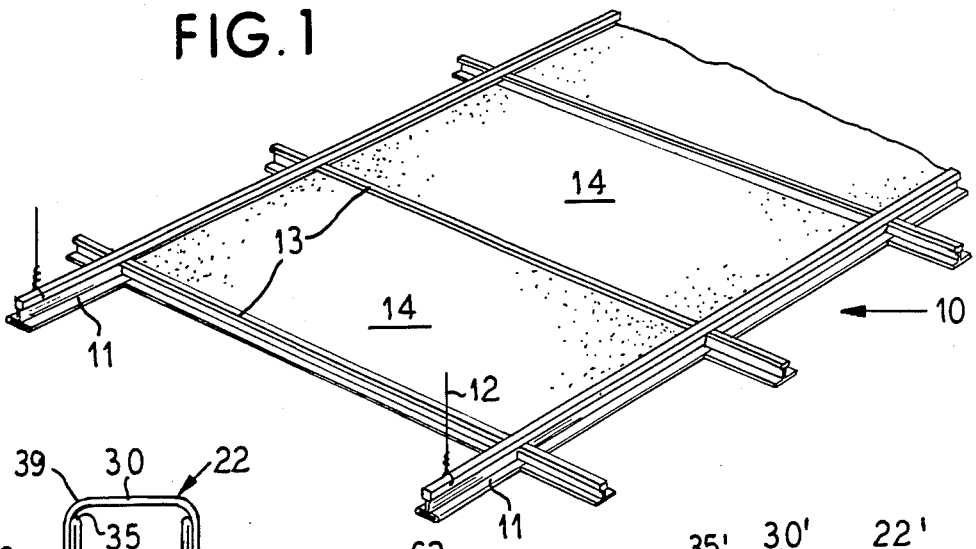
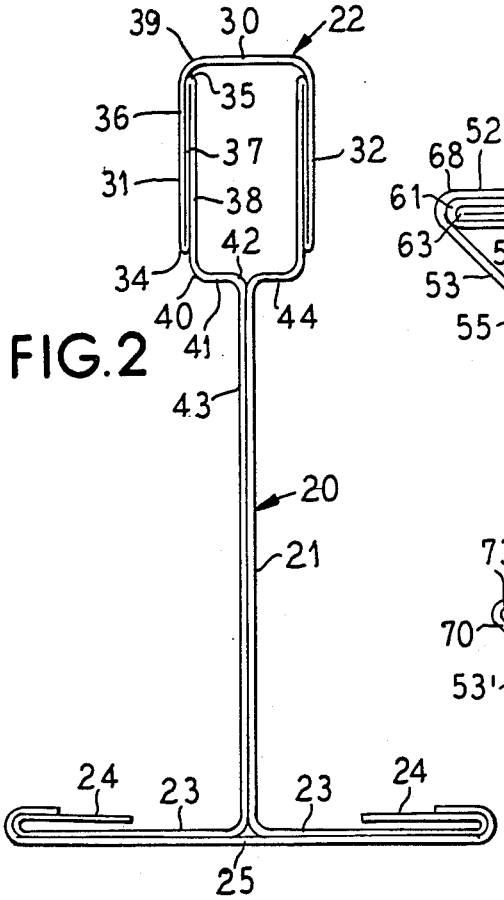
FIG. 2
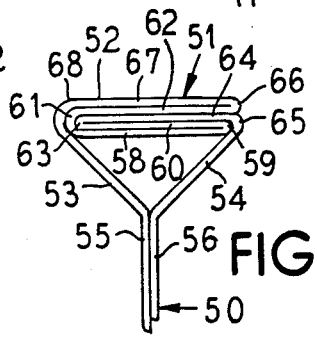
FIG. 4
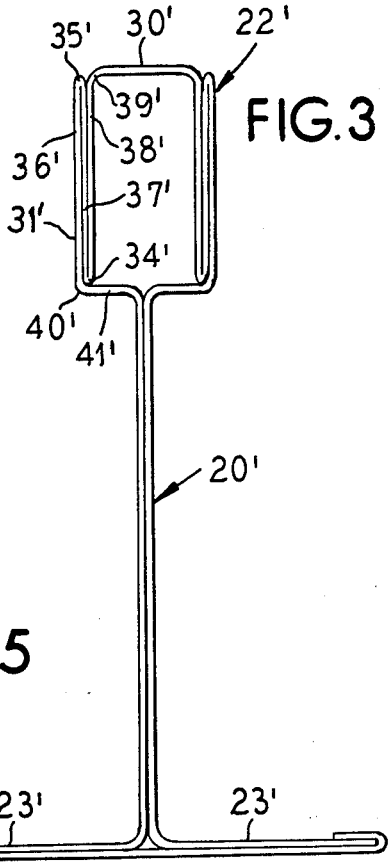
FIG. 3
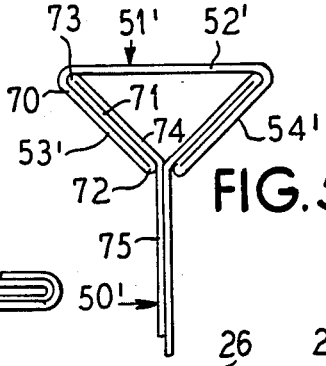
FIG. 5
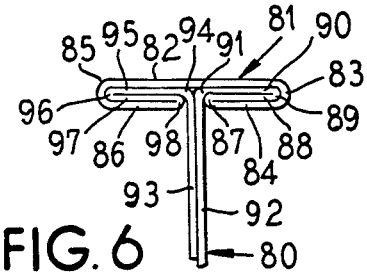
FIG. 6
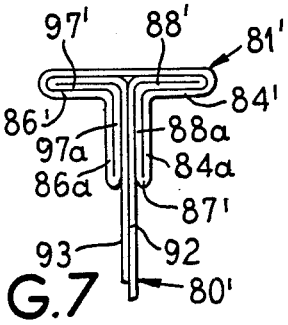
FIG. 7
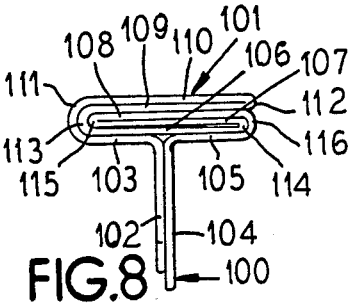
FIG. 8

REINFORCED BEAD

This is a continuation, of application Ser. No 112,549, filed Oct. 26, 1987 now abandoned.

BACKGROUND OF THE INVENTION

The present invention is directed to a grid tee for a suspended ceiling or the like, which has a central web, a continuous bead on one edge of the web and a pair of flanges extending outwardly from the other edge. In order to concentrate more metal in the bead, it is reinforced by having at least one side of the bead composed of a strip of metal which has been bent with at least two reverse bends to provide at least a three layer thickness for the one side and the upper side of the bead will have a continuous outer layer.

Grid tees for suspended ceiling systems have been used for many years. Usually, the grid tee is formed by a sheet of material which has been bent to form a bead along one edge of a central web and opposed or outwardly extending flanges adjacent the other edge so that the cross section of the tee has an inverted T configuration. It is known to bend the sheet so that the web has two thicknesses and the flanges are each a single layer extending outward, which flanges may be covered by a cap strip so that the portion exposed to the occupants of the room can have any desired finish or color.

Recently, it has been suggested to form the grid tee out of a metal strip with a thinner gauge than previously. However, to maintain the rigidity of the component and to prevent rotation or buckling due to loading, arrangements have been made or suggested for reinforcing the bead or bulb of the tee. Examples of two approaches of forming a grid tee out of thin gauge metal with a reinforced bulb are disclosed in a patent to David F. Mieyal, U.S. Reissue Patent No. Re. 31,528; and the Worley et al, U.S. Pat. No. 4,520,609. In the Reissue Patent, the reinforcing is by putting a second or an additional strip of metal in the area of the strip of metal which will be bent into the bulb. While this procedure allows utilizing a heavier sheet of metal for the insert than the rest of the strip used for the tee, there are problems with maintaining the additional sheet in the desired position while bending and forming the main strip into the grid tee.

In the solution suggested by the Worley et al patent, the top of the hollow bead or bulb has a plurality of folds so that a larger amount of material is concentrated at the extremity of the bulb relative to the web to increase the strength of the bulb and to shift the shear center into the web of the tee. However, the solution in Worley results in abutting edges of folds on the outer or top surface of the bead, and these abutting edges of the folds or seams may tend to buckle, due to bending of the tee.

SUMMARY OF THE INVENTION

The object of the present invention is to provide a reinforced bead so that a thin gauge material may be used for forming a grid tee for a suspended ceiling. The object involves folding the strip of material so that there are no exposed abutting seams in the upper and outermost surface of the bead and so that the additional metal is added to the bead to not only shift the neutral axis along the web but to increase the moment of inertia of the bead section about its vertical centroidal axis.

To accomplish these goals and objects, the present invention is directed to a grid tee for a suspended ceiling having a central web, a reinforced bead on an edge of the web, and a pair of oppositely extending panel support flanges on the side of the web opposite said bead, said tee comprises an elongated strip of metal bent substantially along a center to form the reinforced bead with a double layer central web extending from the bead and being bent to form the two flanges, said bead having at least an upper side, said upper side having at least a continuous outer surface of a continuous layer thickness, and said bead having at least one side having at least two reversed bends interconnecting at least three layers of the strip to form a thickness of at least three layers for the one side.

Applicants have found that the rigidity of a grid component in bending depends partly on the compression flange distance from a neutral axis and the shear center of the tee and partly on the moment of inertia about a vertical axis. The top bead is essentially treated as a column in compression and will buckle or just move laterally causing the cross section to rotate. Once the section starts to rotate, it looses all of its rigidity in the direction of vertical bending.

The present invention provides extra metal in the bead to not only shift the neutral axis along the web, but to increase the moment of inertia of the bead section about its vertical centroidal axis. A common feature of all of the embodiments of the present invention are that the upper, outer surface of the bead does not have any exposed abutting seams, but has a continuous outer layer, which covers any abutting seams that are present. This feature also forms a nice, clean surface. In addition, the particular folded layers with reverse bends can be easily formed with a number of roll stands to form the strip into the tee.

Another feature of the invention is that the two flanges have a strip of cap metal clinched onto the outer edges. In one embodiment, the ends of the flanges are provided with a hemmed, or folded-over edge, so that a good, snug fit between the base metal or strip of the tee and the strip forming the cap metal can be obtained.

The tees of the present invention can have beads which are hollow or beads which are formed by a plurality of folded layers that form a substantially solid bead. In the hollow bead embodiments, the hollow beads can have a rectangular cross section with two parallel sides being provided with the folded layers to increase the amount of material, while the top surface is a single, continuous layer, and the two portions adjacent the web are single, continuous layers.

Another modification of the hollow bead is a hollow bead with a triangular configuration. One modification of the triangular bead has the upper surface provided with a plurality of folded layers, while the two leg portions of the bead adjacent the web are a single layer, and another modification has the legs adjacent the web having the folded layers, while the top side or let is a single layer.

With the solid bead embodiment, they can have a modification with four layer thicknesses or a modification with six layers. In addition, the four-layer modification can have a further modification that has portions of the layers extending down along the web for a short distance.

Other advantages and features of the present invention will be readily apparent from the following description of the preferred embodiments, the drawings and claims.

BRIEF DESCRIPTION OF THE DRAWINGS

FIG. 1 is a perspective view with portions broken away for purposes of illustration of a suspended ceiling illustrating the manner in which typical grids are often assembled to support ceiling panels;

FIG. 2 is an end view of a grid member used in the ceiling system of FIG. 1;

FIG. 3 is an end view of a modification of the grid member of FIG. 2;

FIG. 4 is a partial end view showing another modification of a reinforced hollow bead for a grid member, such as used in the ceiling system of FIG. 1;

FIG. 5 is a partial end view illustrating yet another modification of a reinforced hollow bead for a grid member in accordance with the present invention;

FIG. 6 is a partial cross sectional view of a solid reinforced bead for the grid member in accordance with the present invention;

FIG. 7 is a partial end view of a modification of the solid reinforced bead for the grid member in accordance with the present invention; and FIG. 8 is an end view of another modification of a solid reinforced bead in accordance with the present invention.

DESCRIPTION OF THE PREFERRED EMBODIMENTS

The principles of the present invention are particularly useful when incorporated in a grid member, generally indicated at 20 in FIG. 2, for use in a ceiling system, generally indicated at 10 in FIG. 1.

The ceiling system 10 has a plurality of main runners, such as 11, which are supported by wires 12 at a given height for the ceiling. Extending between the main runners 11 are cross members or runners 13, which are connected to the main runner 11 at a given distance or spacing along the main runners to form rectangular openings for receiving panels 14.

Each of the runners 11 and 13 are grid tee members, such as the grid tee member 20 of FIG. 2. The grid tee member 20 has a central web 21 with a reinforced hollow bead 22 on one edge, which is the upper edge, and a pair of flanges 23, 23, that extend in opposite directions along the opposite edge. As illustrated, the flanges 23, 23 have a reversed bend to form a hem edge 24 on which a cap metal strip 25 has been bent around.

In the illustrated embodiment of a ceiling system 10 of FIG. 1 the panels 14 rest on the flanges, such as 23, and, because of the presence of the cap strip 25, the only portion of the grid members visible to occupants of the room having the suspended ceiling, is the cap strip 25. This cap strip 25 can have various colors and/or finishes to provide the desired appearance.

In order to provide or form the grid or beam member 20 of a thinner gauged strip of material to save weight and material, the bead 22 must be reinforced to obtain the desired rigidity for the beam member. In the embodiment of FIG. 2, the grid member 20 has been formed out of a single sheet of material which is bent along its axis or center line to form the hollow bead 22, the double layer central web 21, and the two flanges 22. As illustrated, the bending has resulted in a plurality of right angle bends plus reversed bends so that the hollow bead has a rectangular configuration with an upper side 30 of a single layer thickness joined by right angle bends to parallel sides 31 and 32. The parallel sides 31 have reversed bends 34 and 35 so that the side 31 has an outer layer 36 connected by the reversed bend 34 to an intermediate layer 37, which is connected by the reversed bend 35 to an inner layer 38. As illustrated in the embodiment of FIG. 2, the outer layer 36 is connected at the upper end by a right angle bend 39 to the top side 30. The inner layer 38 is connected by a right angle bend 40 to a bottom side or leg 41, which is connected by a right angle bend 42 to one central web layer 43 that extends to the flange 23. The opposite side 32 also has three layers, which are identical mirror image of the layers 36, 37, 38, which are interconnected by reverse bends and again connected by right angle bends to the top surface 30 and a lower leg 44.

The member 20 has the advantage that the hollow reinforced bead 22 has a smooth upper surface and that the sides 31 and 32 are also smooth so that you have the upper surface and the two parallel side surfaces connected by an outer continuous layer. Another advantage is that you have two sides with three layers each, so that there is a substantial amount of additional material for reinforcing the bead.

A modification of the grid member 20 of FIG. 2 is illustrated by a grid member, generally indicated at 20' in FIG. 3. In this modification, the flanges 23 are not provided with the reverse bend or hem portion 24 so that the cap member 25 is crimped down on outer edges 26. Another modification is that the hollow bead 22' has three layers 36', 37' and 38' for each of the parallel sides, such as the side 31', however, the connection of the layers to the upper surface 30' and the lower leg 41' is opposite. In other words, the right angle bend 39' connects the top layer or upper surface 30' to the inner layer 38' which, in turn, is connected by the lower bend 34' to the intermediate layer 37'. The intermediate layer 37' is connected by the reversed bend 35' to the outer layer 36'. The outer layer 36' at the lower edge is connected by the right angle bend 40' to the bottom side or leg 41'. The modification 20' has the advantage that the sides, such as 41', are that reinforced sides, and also the advantage of a continuous upper side or surface 30', although there is a break or groove formed by the inner layer 38' and 37' adjacent the top side 30'.

The first embodiment of the member 20 and its modification 20' had rectangular hollow reinforcing beads 22 and 22'. In another embodiment, a member 50 has a hollow reinforced bead 51, which has a triangular cross sectional shape with an upper side or layer 52, which is formed of five layers interconnected by reverse bends, and two sides or legs 53 and 54, which extend into the layers 55 and 56 forming the central web.

As illustrated, the top side 52 of the triangular bead 51 has an inner layer 58 connected at one edge or end by a reversed bend 59 to a next outer layer 60, and at the opposite end or edge by a reversed bend 61 to an intermediate layer 62. The layer 60 is connected at the opposite end or edge by a reversed bend 63 to an intermediate layer 64, whose other end is connected by a bend 65 to the side 54. The layer 62 is connected by a reversed bend 66 to a layer 67, which is the outermost layer, which is connected at the other end or edge by a bend 68 to the side 53. This embodiment provides five layers on the top surface of the triangular, hollow bead, which has the advantage of providing a large amount of reinforcing material.

Like the embodiment 20 and its modification 20', the side legs or layers 53 and 54, which are connected to the layers 55, 56, making the web, are a single thickness, like the sides 41 and 41'.

A modification of the reinforced triangular bead of the member 50 is shown by the member 50', who has a reinforced triangular hollow bead 51'. In the bead 51', the top side 52' is a single layer, while the two sides or legs 53' and 54' are composed of reversed bends and three layers. In particular, the side 53', for example, has an outer layer 70 connected by a bend to the upper layer 52', an intermediate layer 71 connected by a reversed bend 72 to the outer layer 70, and by a reversed bend 73 to an inner layer 74. This inner layer 74 is connected by a partial bend to a central web-forming layer 75. The side 54' is a mirror image of the side 53'. The bead 51', thus, has a substantial amount of reinforcement material in the multi-layer sides 53', 54'. Like the bead 22 and 22' of the embodiment 20 and its modifications 20', the upper surface 52' is a single layer, while the sides are multi-layers. Also, like the embodiment of the grid member 20, the outer layers, such as 70, for the side 53' and the layer forming the upper surface 52' are continuous so that you have a clean outer configuration for the reinforced bead.

All the members 20, 20', 50 and 50' have hollow beads. An embodiment of the grid member is illustrated by the member 80, which has a solid reinforcing bead 81, which has substantially a thickness of four layers. As illustrated, the bead 81 has its continuous upper layer 82 connected at one end by a reverse bend 83 to a lower layer 84 and, at the other end by a reverse bend 85 to a lower layer 86. The lower layer 84 is connected by an inner reversed bend 87 to an inner layer 88, which in turn is connected by a reverse bend 89 to an inner layer 90. The inner layer 90 is connected by a right angle bend 91 to one layer 92 of the central web for the member. The other layer 93 of the central web is connected by a right angle bend 94 to an inner layer 95 which is connected by a reverse bend 96 to another inner layer 97, which is connected by a reverse bend 98 to the lower web or layer 86. The member 80 has the advantage that it is extremely easy to manufacture with the least number of roll stands, since the number of bends are less. For example, the layers 84 and 88 are folded under extensions of the layers 81 and 90, respectively.

A modification of the member 80 is shown (FIG. 7) by the member 80', which has a bead 81'. This modification has the layer, such as 84' and 88' elongated to provide portions **84*a* and 88*a*, which are connected by a right angle bend to the main portion so that these portions 84*a* and 88*a* extend along a web layer 92 for a short distance. In a similar manner, the layers 86' and 97' have portions 86*a* and 97*a*, which are connected by a right angle bend to the main part and also extend along the web portion or layer 93 so that the bead 81'** has a T-shaped configuration, as illustrated.

A fourth embodiment of the grid member is illustrated by the embodiment 100 of FIG. 8. In this embodiment, the reinforced bead 101 is composed of six layers. Starting at one side, a web layer 102 is connected by a right angle bend to a tee layer 103, while the other web portion 104 is connected by a right angle bend to a tee layer 105, which is in the same plane as the layer 103. Immediately above he layers 105 and 103, the bead has layers 106, 107, 108, 109, and the outer upper layer 110. The outer or top layer 110 is connected at one edge by a reversed bend 111 to the bottom or tee layer 103, while at the other edge is connected by a reverse bend 112 to the layer 109. The layer 109 is connected by a reverse bend 113 to the layer 106. The layer 106 at the other edge is connected by a reversed bend 114 to the layer 107. The layer 107 is connected at the other edge by a reverse bend 115 to the layer 108, which is, in turn, connected by a reverse bend 116 to the other bottom or tee layer 105. The bead 101 can be formed by forming the strip into a double thickness, which has a width approximately three times the width of the bead 101. This double thickness is then folded to form the reverse bends 114 and 116 and then the portions 109 and 110 are folded on the reverse bends 111 and 113 to cover the layers 107 and 108. This arrangement, as in the previous solid bead arrangement, provides a large amount of material in the reinforced bead.

Although various minor modifications may be suggested by those versed in the art, it should be understood that we wish to embody within the scope of the patent granted hereon all such modifications as reasonably and properly come within the scope of our contribution to the art.

We claim:

1. A grid tee for a suspended ceiling having a central web, a reinforced bead on one edge of the web and a pair of oppositely extending panel support flanges on an edge of the web opposite said bead, said tee comprising an elongated strip of metal bent substantially along a center line to form the bead with a double layer central web extending from the bead and being bent to form the flanges, said bead having at least one side with the strip being bent to have at least two reversed bends interconnecting three layers of the strips to form a thickness of at least three layers for the one side, and said bead having an upper side having a continuous outer layer to form a continuous outer surface for the upper side.

2. A grid tee according to claim 1, wherein the reinforced bead is a solid bead with the one side being the upper side and having at least four layer thicknesses.

3. A grid tee according to claim 2, wherein said reinforced bead has a pair of outwardly extending layers bent at right angles to the layers of the central web covered by an upper layer, said outwardly extending layers and upper layer being connected by reversed bends to two layers folded under the outwardly extending layers on each side of the bead to form a bottom two layers for the bead.

4. A grid tee according to claim 3, wherein the bottom two layers on each side of the bead have portions connected by right angle bends extending along top portions of the layers forming said central web so that the bead has a T-shaped configuration.

5. A grid tee according to claim 2, wherein the solid bead has six layers with an upper two layers overlapping a middle two layers which rest on a bottom two layers.

6. A grid tee according to claim 2, wherein the bead has six layers.

7. A grid tee according to claim 1, wherein the reinforced bead is a hollow reinforced bead with a cross section with the upper side and two other sides.

8. A grid tee according to claim 7, wherein the upper side is a single layer connected to two sides having at least three layers each.

9. A grid tee according to claim 8, wherein an outer layer of each of the two sides is connected to the single layer of the upper side of the bead.

10. A grid tee according to claim 9, wherein the hollow reinforced bead has triangle configuration and an inner layer of each of the two sides is connected by a bend to the layers forming the central web.

11. A grid tee according to claim 8, wherein the hollow reinforced bead has a rectangular configuration and the two sides extend parallel to each other.

12. A grid tee according to claim 11 wherein an inner layer of each of the two sides of the bead are connected to the single layer of the upper side by a right angle bend.

13. A grid tee according to claim 11, wherein the single layer of the upper side of the bead is connected by right angle bends to each of the outer layers of the two sides of the hollow bead.

14. A grid tee according to claim 7, wherein the hollow reinforced bead has two side portions of a single layer connected to the layers forming the central web.

15. A grid tee according to claim 14, wherein the upper side is the one side and has a thickness of five layers.

16. A grid tee according to claim 7, wherein the hollow reinforced bead has only three sides arranged in a triangular configuration.

17. A grid tee according to claim 16, wherein the upper side is a single layer and the two sides of the triangular bead have the three layer thickness.

18. A grid tee according to claim 16, wherein the one side having at least three layers is the upper side and has a thickness of five layers.

19. A grid tee according to claim 1, wherein each of said flanges has an outer edge with a reversed bend and said tee includes a cap strip having edges bent on said reverse bends of the flanges.

20. A grid tee for a suspended ceiling having a central web, a reinforced bead on one edge of the web and a pair of oppositely extending flanges for supporting panels on an opposite edge of the web from said bead, said tee being composed of an elongated strip of metal bent substantially along a longitudinal center to form the bead with a double layer central web extending from the bead and being bent to form the flanges, said bead being formed by the strip being bent with reverse bends to form a solid bead having a thickness of four layers with an inner two layers of the layer being formed by outer edges of an outer two layers of the four layers being folded underneath the outer two layers and with the layer of the bead most remote from the flanges being a continuous layer.

21. A grid tee according to claim 20, wherein the inner two layers of the four layers have portions extending for a short distance along the webs to form a T-shaped configuration for the reinforced bead.

22. A grid tee for a suspended ceiling having a central web, a reinforced bead on one edge of the web and a pair of flanges extending in opposite directions from an opposite edge of the web for supporting panels, said tee comprising an elongated strip being bent along a center line to form the bead with a double layer central web extending from the bead and being bent to form the flanges, said bead having a hollow configuration with an upper side of hollow configuration having at least an outer continuous layer to form an outer continuous upper surface for the bead and said bead having at least one side of the configuration having at least three layers interconnected by two reversed bends.

23. A grid tee according to claim 22, wherein the bead has two sides having at least three layers each and the upper side of the hollow bead is a single layer which is connected to the two sides.

24. A grid tee according to claim 23, wherein the bead has a rectangular configuration.

25. A grid tee according to claim 23, wherein the hollow bead has a triangular configuration.

26. A grid tee according to claim 22, wherein the hollow bead has only three sides arranged in a triangular configuration and the one side having at least three layers is the upper side and has a thickness of five layers.

27. A grid tee for a suspended ceiling having a central web, a reinforced bead on one edge of the web and a pair of flanges extending in opposite directions from an opposite edge of the web for supporting panels, said tee comprising an elongated strip being bent along a center line to form a hollow bead with a double layer central web extending from the hollow bead and being bent to form the flanges, said hollow bead having a hollow rectangular configuration with an upper side extending between two parallel lateral sides, each of said two lateral sides having a portion of three layers interconnected by two reversed bends adjacent said upper side, said upper side being a single layer connected by right angle bends to an outer layer of each portion of the two parallel lateral sides to form an outer continuous upper surface for the hollow bead.

* * * * *